US006775940B2

(12) United States Patent
Dworzan et al.

(10) Patent No.: US 6,775,940 B2
(45) Date of Patent: Aug. 17, 2004

(54) MOTION DETECTING SAFETY DEVICE

(75) Inventors: William S. Dworzan, Santa Ana, CA (US); Lawrence J. Zadra, Laguna Hills, CA (US)

(73) Assignee: S/R Industries, Inc., Huntington Beach, CA (US)

( * ) Notice: Subject to any disclaimer, the term of this patent is extended or adjusted under 35 U.S.C. 154(b) by 0 days.

(21) Appl. No.: 10/369,088

(22) Filed: Feb. 14, 2003

(65) Prior Publication Data

US 2004/0025392 A1 Feb. 12, 2004

Related U.S. Application Data

(60) Provisional application No. 60/361,472, filed on Mar. 1, 2002, and provisional application No. 60/357,728, filed on Feb. 18, 2002.

(51) Int. Cl.[7] ..... F41A 9/53

(52) U.S. Cl. ..... 42/1.01; 42/54; 42/70.01; 42/106

(58) Field of Search ..... 42/1.01, 70.01, 42/106, 90, 54

(56) References Cited

U.S. PATENT DOCUMENTS 5,715,623 A * 2/1998 Mackey, III ..... 42/1.01
6,200,188 B1 * 3/2001 Filo ..... 446/175
6,305,941 B1 * 10/2001 Kotsiopoulos et al. ..... 434/11
6,523,295 B1 * 2/2003 Midgley ..... 42/70.01

* cited by examiner

*Primary Examiner*—J. Woodrow Eldred
(74) *Attorney, Agent, or Firm*—Knobbe, Martens, Olson & Bear, LLP

(57) ABSTRACT

A safety device for use with a toy guns, less-lethal guns (such as non-powdered guns) and lethal guns detects motion of the gun, and causes light emitting diodes or other light sources incorporated into the gun to prominently flash. The flashing light sources alert bystanders in a way that distinguishes lethal firearms from toy guns and less-lethal guns. The flashing diodes can also be activated when the gun is armed, cocked or otherwise ready to be fired. Motion is detected through the use of an electric circuit that includes a spring, an oscillating mass, and a ring adapted to surround the oscillating mass.

32 Claims, 4 Drawing Sheets

MOTION DETECTING SAFETY DEVICE

PRIORITY APPLICATIONS

This application claims priority under 35 U.S.C. § 119(e) from U.S. Provisional Patent Application Ser. No. 60/357,728, entitled "Motion Detecting Safety Device for Use with Less Lethal and Toy Guns" and filed Feb. 18, 2002; and from U.S. Provisional Patent Application Ser. No. 60/361,472, entitled "Motion-Detecting Safety Device to Distinguish Less Lethal and/or Toy Guns from Authentic Powdered Firearms" and filed Mar. 1, 2002. The entire disclosure of these priority documents is hereby incorporated by reference in its entirety.

FIELD OF THE INVENTION

The present invention relates generally to a motion detecting safety device, and more specifically to a motion detecting safety device configured to distinguish toy guns and less-lethal guns from lethal firearms.

BACKGROUND OF THE INVENTION

A wide variety of guns are available to consumers. Certain guns cannot fire projectiles, or can only fire projectiles that are substantially incapable of causing bodily harm; such guns are referred to herein as "toy guns". Other guns are capable of firing projectiles at velocities that may cause bodily harm, but are unlikely to cause death; such guns are referred to herein as "less-lethal guns". Finally, certain guns are capable of launching projectiles at velocities that are likely to cause a fatal injury if fired at a susceptible part of the body; such guns are referred to herein as "lethal firearms".

Regardless of a particular gun's firing capabilities, many toy guns and many less-lethal guns have a realistic appearance that is not easily distinguished from a lethal firearm. Indeed, the appearance of many toy guns and many less-lethal guns has become so realistic that the users of such devices may inadvertently threaten people who are unaware of the gun's true nature. In cases where those who are threatened are themselves armed with lethal firearms, such as police officers in certain jurisdictions, the consequences of the false threat from a less-lethal gun or a toy gun can be tragic. Thus, it is desired to clearly and prominently distinguish toy guns and less-lethal guns from lethal firearms.

One solution that has been proposed to address this desire is to paint at least a portion of a toy gun or less-lethal gun with a distinctive color, such as fluorescent orange or fluorescent green. For example, if the muzzle or barrel is painted with a distinctive color, ideally one who is threatened with the gun will be able to identify the gun as a toy gun or a less-lethal gun. However, such a configuration is often minimally effective or wholly ineffective in low light conditions, such as during nighttime.

It has also been suggested that different colors be used to distinguish less-lethal guns from both toy guns and lethal firearms. However, as discussed above, such coloration is often minimally effective or wholly ineffective under low light conditions. Furthermore, such designs may not be effective in situations where the person threatened cannot clearly see the colored portion of the gun. Thus, the painting of portions of less-lethal guns or toy guns using distinctive colors is not an effective means for clearly and prominently distinguishing less-lethal or toy guns from lethal firearms.

SUMMARY OF THE INVENTION

Thus, in accordance with the foregoing, it is desired to develop an effective means for quickly distinguishing between toy guns, less-lethal guns, and lethal firearms, thereby allowing one who is threatened with such a device to accurately identify the type of gun being wielded, as well as the appropriate responsive action. Preferably, such a device could also be used in conjunction with lethal firearms, thus allowing lethal firearms belonging to authorized users to be readily identified.

According to one embodiment of the present invention, a safety-enhanced gun comprises a gun housing. The gun housing has an external surface and an internal surface. The safety-enhanced gun further comprises an elongate, electrically-conductive spring. The spring has a first end and a second end. The first end is secured to the gun housing. A conductive mass is secured to the second end. The second end is free to oscillate the safety-enhanced gun further comprises a conductive ring. The conductive ring has a conductive ring inner diameter. The conductive ring is secured to the gun housing. The conductive ring surrounds the conductive mass, such that oscillation of the conductive mass with an amplitude greater than the conductive ring inner diameter will cause the conductive mass to contact the conductive ring. The safety-enhanced gun further comprises a light source electrically connected to the conductive ring and the spring. The light source is configured such that when the conductive mass contacts the conductive ring, light is emitted from the light source.

According to another embodiment of the present invention, a method of identifying a gun comprises securing an oscillating mass to a gun housing. The method further comprises illuminating a light source when the oscillating mass oscillates with an amplitude greater than a threshold amplitude. The light source is mounted to the gun housing. The color of light emitted from the light source provides information about a firing characteristic of the gun. The method further comprises illuminating the light source when the gun is armed.

According to another embodiment of the present invention, a safety-enhanced gun comprises a gun selected from the group consisting of a toy gun, a less-lethal gun, and a lethal firearm. The safety-enhanced gun further comprises a motion sensor internal to the gun. The safety-enhanced gun further comprises a light source electrically connected to the motion sensor. The light source is lighted when the motion sensor detects motion. The light source is color-coded to convey the identity of the gun as a toy gun, a less-lethal gun, or an authentic firearm.

According to another embodiment of the present invention, a method of identifying a gun as a toy gun, a less-lethal gun, or an authentic firearm comprises moving the gun, thereby activating a motion sensor. The method further comprises illuminating a light source mounted to or within a portion of the gun when the motion sensor is activated. The illumination of the light source identifies the gun as a toy gun, a less-lethal gun, or an authentic firearm.

DETAILED DESCRIPTION OF PREFERRED EMBODIMENTS

The preferred embodiments of the motion detecting safety device described herein can be incorporated into toy guns, less-lethal guns and lethal firearms. When the motion detecting safety device described herein is installed on a gun, motion of that gun causes light emitting diodes or other light sources incorporated into the gun to flash prominently. The flashing light sources alert bystanders in a way that distinguishes lethal firearms from toy guns or less-lethal guns. Alternatively, the flashing light sources can alert bystanders that the possessor of a lethal firearm is an authorized possessor. The flashing light sources can also be activated when the gun is armed, cocked or otherwise ready to be discharged.

Figure 1:
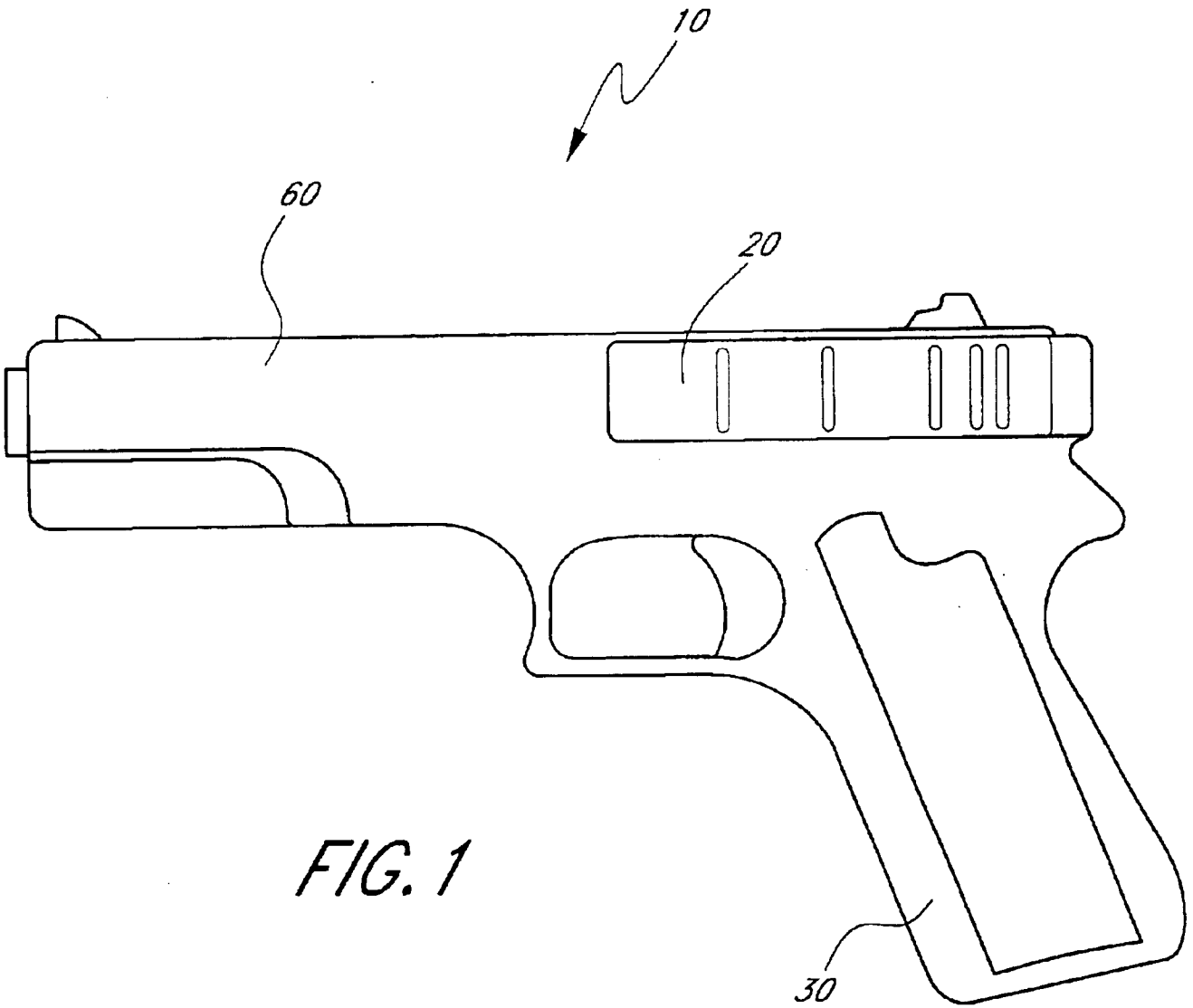
FIG. 1 is a perspective illustration of a gun that includes a motion detecting safety device.
Figure 2:
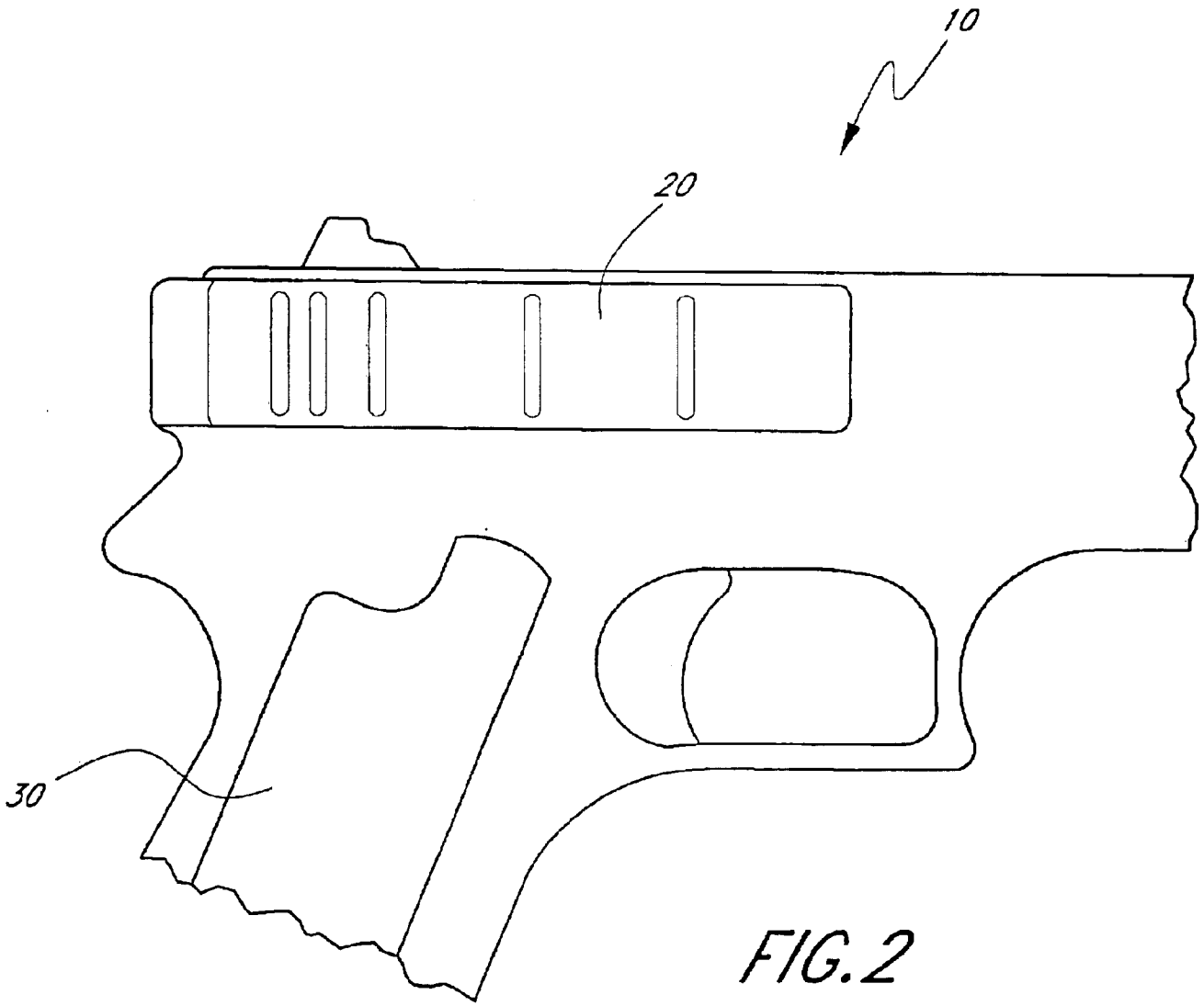
FIG. 2 is a close-up illustration of a cocking mechanism and a plastic light transmission device of the gun illustrated in FIG. 1.

FIGS. 1 and 2 illustrate a gun 10 that includes a motion detecting safety device. In such embodiments, a gun 10 is outfitted with an internal motion sensor and one or more light emitting diodes which are incorporated into a light transmission device 20 that is adapted to disperse the light emitted from the light emitting diodes in substantially all directions from the gun 10.

The gun 10 can be one that is not capable of firing projectiles or one that is substantially incapable of causing bodily harm (a "toy gun"), or it may be one that is capable of firing projectiles at velocities that may cause bodily harm, but that is unlikely to cause death (a "less-lethal gun"). For example, the gun 10 can comprise any of a variety of non-powdered guns, such as a BB-gun, an air gun, a spring-loaded gun, or some forms of a pellet gun. Such guns may or may not be capable of launching a projectile at a velocity capable of fatally injuring a person. The gun 10 can be comprised of any rigid material, such as plastic or metal, and can, but need not, be configured to closely resemble the size, shape, and feel of an lethal firearm.

Figure 3:
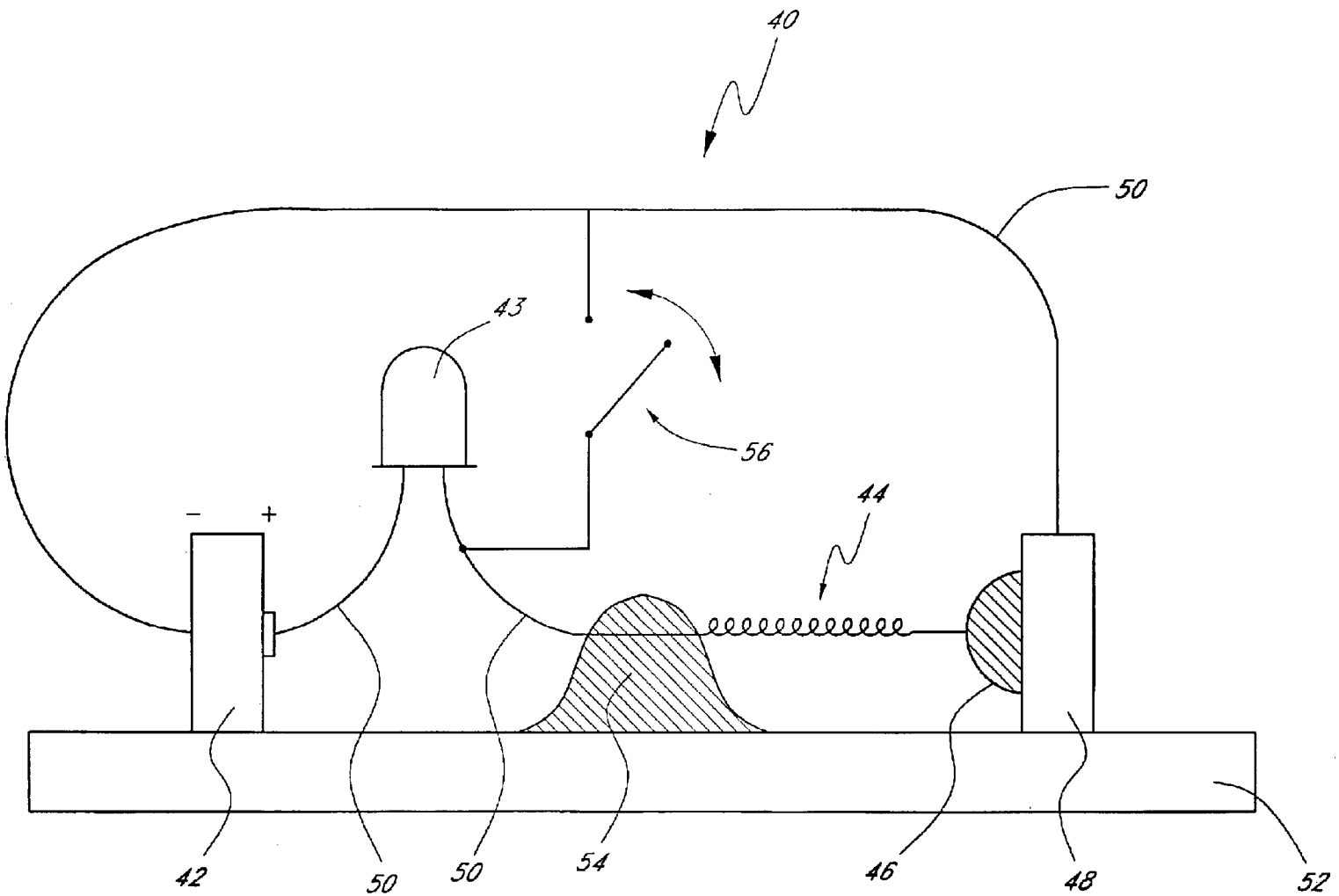
FIG. 3 is a schematic illustration of the motion detecting safety device included in the gun illustrated in FIG. 1.

The gun 10 includes an internal motion sensor 40, schematically illustrated in FIG. 3, that is preferably located within the body of the gun 10. For example, the internal motion sensor can be located within the handle 30 or the muzzle 60 of the gun 10. In a preferred embodiment, the internal motion sensor 40 comprises an electric circuit that includes a voltage source 42, a light emitting diode 43, a spring 44, a mass 46, a ring 48, a switch 56 and a plurality of wires 50. The mass 46 is attached to one end of the spring 44, and is adapted to fit within the ring 48 without touching the ring 48 when the internal motion sensor 40 is stationary. The ring 48 and the voltage source 42 are attached to a rigid insulating base plate 52. The end of the spring 44 that is not weighted with the mass 46 is also fixed to the rigid insulating base plate 52 with an insulating epoxy 54. A variety of other motion sensors will be well known to those having ordinary skill in the art; for example, sensors that make use of a mercury switch, or spring sensors without weights, among others, can readily be incorporated into a gun 10.

The use of light emitting diodes 43 allows the voltage source 42 to be small, such as that used to create a voltage difference of less than two volts. Although light emitting diodes are preferred light sources in view of their long life, resistance to damage through impact, low power requirements and low cost, other low-power light sources can also be used. Preferably, the voltage source 42 comprises one or more batteries, connected in parallel, capable of producing a small direct current. In other embodiments, multiple batteries are provided in a queue. In such embodiments, a mechanism is provided to remove from the electric circuit a battery that has been used to the point that it is incapable of producing a sufficient current to illuminate the light emitting diodes. Such a mechanism is also preferably capable of inserting a fresh battery from the queue into the electric circuit. Most preferably, the voltage source is capable of illuminating the light emitting diode or the light emitting diode array for a period at least as long as the life of the gun. Or, in a modified embodiment, the voltage source 42 can be replaced by the user as necessary.

The spring 44, the mass 46 and the ring 48 all are preferably comprised of an electrically conducting material. Thus, as illustrated in FIG. 3, the electric circuit of the internal motion sensor 40 can be closed by placing the mass 46 in contact with the ring 48, or by closing the switch 56. When the electric circuit is closed, electric current flows through the light emitting diode 43, thereby causing the light emitting diode 43 to emit light.

Movement of the internal motion sensor 40 will cause the mass 46 at the end of the spring 44 to oscillate. If the amplitude of the oscillations is greater than the inner diameter of the ring 48, then as the mass 46 oscillates, it will intermittently contact the ring 48, thereby intermittently closing the electric circuit and illuminating the light emitting diode 43. Thus, any movement of the internal motion sensor 40 that causes the mass 46 to oscillate with an amplitude greater than the inner diameter of the ring 48 will cause the light emitting diode 43 to illuminate intermittently. The sensitivity of the internal motion sensor 40 may be adjusted by changing the length of the spring 44, the flexibility of the spring 44, or the inner diameter of the ring 48.

In other embodiments, circuitry (not shown) can be incorporated into the electric circuit to cause the light emitting diode 43 to remain illuminated for a predetermined period of time when the mass 46 contacts the ring 48. Alternatively, the circuitry can be configured to cause the light emitting diode 43 to flash rapidly when the mass 46 contacts the ring 48, thereby further increasing the visibility and prominence of the gun 10. These configurations both facilitate detection of small movements of the internal motion sensor 40, which would otherwise cause the light emitting diode 43 to illuminate only briefly. Such circuitry is well known to those of ordinary skill in the art.

As mentioned above, the electric circuit can also be closed by closing the switch 56. Thus, whenever the switch 56 is closed, current will flow through the electric circuit, thereby illuminating the light emitting diode 43. In certain embodiments, especially adapted for use with less-lethal guns, the switch 56 is connected to the arming mechanism of the gun 10, thereby causing the switch 56 to close whenever the gun 10 is armed and thus ready to be fired. Such a configuration further increases the safety of the gun 10 by further alerting the user of the gun 10, as well as bystanders, that the gun 10 is armed and ready to be fired.

Thus, in such embodiments, whenever the gun 10 is moved or armed, the light emitting diode 43 will become illuminated, thereby alerting those in the vicinity that the gun 10 is not a lethal firearm, but is armed to fire a "less-lethal" projectile (such as, for example a BB pellet or a paint ball). This prevents bystanders who may otherwise be threatened by the realistic-looking gun from taking dangerous action in response to the person wielding the gun. In other embodiments, bystanders can be alerted that the person possessing a lethal firearm is an authorize possessor.

Figure 4A:
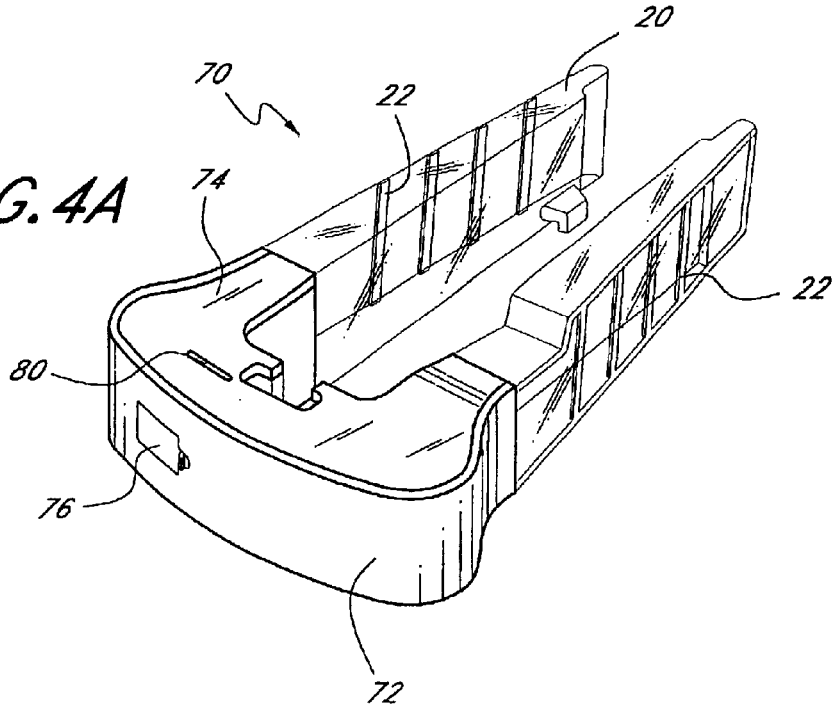
FIG. 4A is a perspective view of a modular motion detector adapted for attachment to a gun.
Figure 4B:
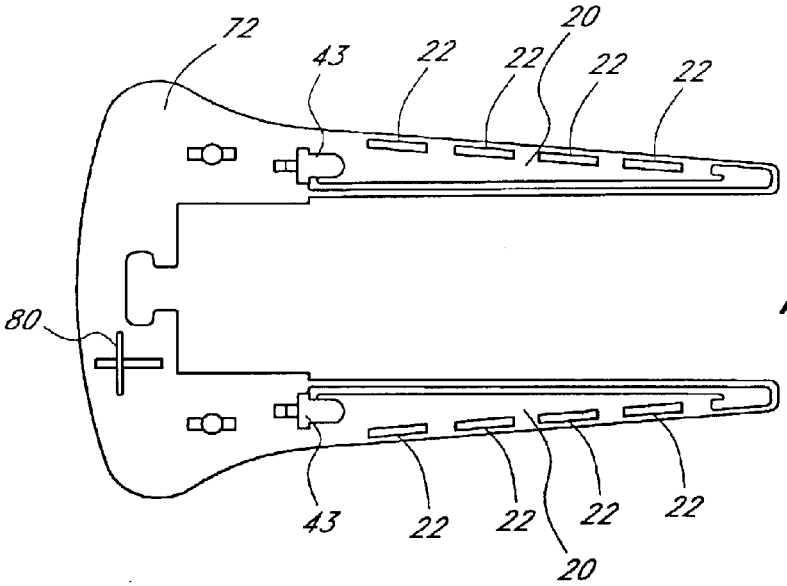
FIG. 4B is a top cover for the modular motion detector illustrated in FIG. 4A.
Figure 4C:
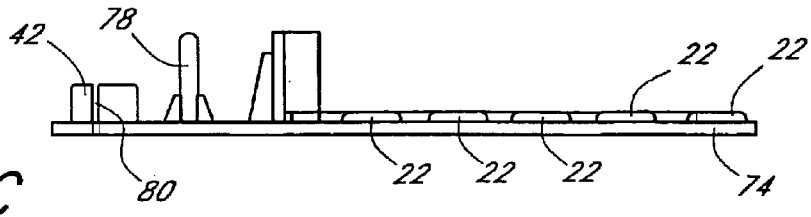
FIG. 4C is a bottom cover for the modular motion detector illustrated in FIG. 4A.

In modified embodiments, the motion sensor can be incorporated into a modular unit that can be easily added as an after-market or pre-sale device into existing less-lethal guns, toy guns, or authentic firearms. Such an embodiment is illustrated in FIGS. 4A through 4C. Specifically, by placing an exterior cover over the motion sensor to form an enclosed modular unit 70, and by attaching the modular unit 70 to the gun, the motion sensor can be adapted to detect motion of the gun 10. For example, in the embodiment illustrated in FIG. 4A, the exterior cover comprises a top and sidewall exterior cover portion 72 (illustrated in FIG. 4B) configured to mate with a bottom exterior cover portion 74 (illustrated in FIG. 4C). In such embodiments, the components of the exterior cover can further comprise internal support structures 78 configured to secure the two exterior cover pieces together. For example, the two exterior cover pieces can be secured together by a snap fit or an epoxy-covered surface. The components of the exterior cover can also be configured to support the voltage source 42 and the light emitting diodes 43.

The light transmission device 20, described above, can be incorporated into the top and sidewall exterior cover portion 72, as illustrated in FIG. 4B. In addition, light reflectors 22 can optionally be positioned within the light transmission device 20, thereby further serving to disperse the light from the light emitting diodes 43 broadly.

Using a removable modular unit 70 allows the motion sensor to be removed and replaced if any components thereof become worn or otherwise cease to function, such as would occur if the voltage source was to fail. In other embodiments, the top and sidewall exterior cover portion 72 further includes a voltage source access door 76 via which the user can replace the voltage source as necessary.

In a modified embodiment, and as illustrated in FIGS. 4B and 4C, a slot 80 can be formed in the top and sidewall exterior cover portion 72 over the voltage source 42. In such embodiments, an electrical insulator (not shown) can be inserted into the slot 80, thereby opening the electrical circuit and effectively "turning off" the motion sensor. Examples of an appropriate electrical insulating include a piece of paper, or a thin plastic slide. Such a feature may be desired if the motion sensor must be shipped for a long period of time, thereby preventing the voltage source from unduly draining.

In other embodiments, the light emitting diode 43 comprises an array of multiple light emitting diodes that are connected in series, and that are located on various parts of the gun 10, thereby making the illuminated light emitting diodes prominently visible to any persons located near the gun 10. For example, in certain embodiments, one or more light emitting diodes are placed on the muzzle 60 of the toy gun 10, thereby making them prominently visible to anyone at whom the gun 10 is pointed.

In alternative embodiments, the gun 10 further comprises a light transmission device 20, as illustrated in FIGS. 1 and 2. The light transmission device 20 preferably covers one or more of the light emitting diodes, and transmits the light emitted from the light emitting diodes to various exterior regions of the gun 10 such as the muzzle 60 and the handle 30. This configuration provides the advantages of permitting the light activated safety device to be prominently visible to any persons located near the gun 10 without requiring the incorporation of multiple light emitting diodes into the gun 10. The light transmission device 20 also facilitates the dispersion of the light emitted from the light emitting diodes into an approximately 360-degree field of view. Preferably, the light transmission device comprises a material that readily transmits light, such as a translucent plastic.

In other embodiments, the color of the light emitting diode used in the motion sensing device may provide information on the type of gun to which the motion sensing device is attached. For example, in one safety scheme, for toy guns, a green light emitting diode can be used; for less-lethal guns, a yellow light emitting diode can be used; and for lethal guns that are still less-lethal than a lethal firearm, a red light emitting diode can be used. Lethal guns that fall into this last category (that is, deserving of a red light emitting diode) would include air guns that fire projectiles at speeds over 350 feet/second (110 m/sec). Such a configuration allows bystanders or those threatened with a gun to quickly assess the level of danger that the gun poses, and the appropriate responsive measures. Lethal firearms that fire bullets using explosive force might also be equipped with yet another color to identify them as such.

Still other embodiments include a photodiode or other device that senses the presence or relative absence of ambient light. The inclusion of such a light-detection device can provide the invention with the ability to turn on the safety flashing circuit only when ambient light conditions are below a preset level. Thus, the light emitting diodes or other light sources need only be activated in conditions under which the light sources can be seen, thereby substantially extending battery life.

The motion sensing safety device described herein reduces the likelihood that toy guns and less-lethal guns will be mistaken for lethal firearms. Unlike solutions that involve coloring the barrel of the gun, the motion sensing safety device is effective in low-light conditions, and by using high-intensity light emitting diodes, the gun is made visible from a great distance. Furthermore, the use of a light emitting diode array, or the use of a light transmission device 20, reduces the likelihood that the gun 10 can be easily concealed, thereby further increasing the overall safety of the gun 10.

In addition, the motion sensing safety device does not need to be independently activated by the user, and is difficult for the user to defeat if it is incorporated into the body of the gun. The only component that may require replacement with extended use is the voltage source 42. The need to replace the voltage source 42 may be eliminated by adding multiple voltage sources connected in parallel, thereby providing a virtually unlimited lifetime for the motion sensing safety device in comparison to the lifetime for the gun itself. Providing a non-replaceable voltage source further reduces the possibility that the safety device may be defeated by the user. Alternately, circuitry may be provided to disable the gun using a mechanical locking device that prevents the gun from being armed once the voltage source has insufficient voltage to illuminate the light emitting diode or the light emitting diode array. In such embodiments, the user would return the gun to an authorized service center for replacement of the voltage source.

We claim:

1. A safety-enhanced gun comprising:

a gun selected from the group consisting of a toy gun, a less-lethal gun, and an authentic firearm;

a motion sensor internal to the gun; and a light source electrically connected to the motion sensor such that the light source is lighted when the motion sensor detects motion, wherein the light source is color-coded to convey the identity of the gun as a toy gun, a less-lethal gun, or an authentic firearm.

2. The safety-enhanced gun of claim 1, wherein the light source is adapted to blink on and off when motion is detected.

3. The safety-enhanced gun of claim 1, wherein the light source is also lighted when the gun is armed.

4. The safety-enhanced gun of claim 1, wherein when the gun is moved or armed, the light source remains illuminated for a preset minimum duration.

5. The safety-enhanced gun of claim 4, wherein the present minimum time duration is approximately five seconds.

6. The safety-enhanced gun of claim 1, further comprising a light transmission device configured to transmit light from the light source to a muzzle portion of the gun.

7. The safety-enhanced gun of claim 6, wherein the light transmission device comprises a translucent plastic.

8. The safety-enhanced gun of claim 1, further comprising a power source configured to provide electrical power to the light source.

9. The safety-enhanced gun of claim 8, wherein the power source comprises a user-replaceable dry cell battery.

10. A method of identifying a gun as a toy gun, a less-lethal gun, or an authentic firearm, comprising:

moving the gun, thereby activating a motion sensor;

illuminating a light source mounted to or within a portion of the gun when the motion sensor is activated, whereby the illumination of the light source indicates that the gun is a toy gun, a less-lethal gun, or an authentic firearm.

11. The method of claim 10, wherein the light source is also illuminated when the gun is armed.

12. The method of claim 10, wherein illuminating the light source comprises causing the light source to flash on and off.

13. The method of claim 11, wherein when the gun is moved or armed, the light source remains illuminated for a preset minimum duration.

14. The method of claim 13, wherein the present minimum time duration is approximately five seconds.

15. The method of claim 13, further comprising providing a user-accessible power source configured to provide electrical power to the light source.

16. A safety-enhanced gun comprising:

a gun housing having an external surface and an internal surface;

an elongate, electrically-conductive spring having a first end and a second end, wherein the first end is secured to the gun housing and a conductive mass is secured to the second end, such that the second end is free to oscillate;

a conductive ring having a conductive ring inner diameter, secured to the gun housing and surrounding the conductive mass, such that oscillation of the conductive mass with an amplitude greater than the conductive ring inner diameter will cause the conductive mass to contact the conductive ring;

a light source electrically connected to the conductive ring and the spring, such that when the conductive mass contacts the conductive ring, light is emitted from the light source.

17. The safety-enhanced gun of claim 16, further comprising a power source electrically connected to the light source.

18. The safety-enhanced gun of claim 17, wherein the power source comprises a plurality of dry cell batteries configured such that if one of the plurality of dry cell batteries becomes incapable of powering the light source, an alternate dry cell battery will provide electrical power to the light source.

19. The safety-enhanced gun of claim 17, wherein the power source can be replaced by a user.

20. The safety-enhanced gun of claim 16, wherein the spring first end and the conductive ring are secured to the gun housing internal surface.

21. The safety-enhanced gun of claim 16, wherein the spring first end and the conductive ring are secured to a removable assembly mounted on the gun housing external surface.

22. The safety-enhanced gun of claim 21, wherein the removable assembly further comprises an integral power source.

23. The safety-enhanced gun of claim 16, further comprising a light transmission device configured to transmit light from the light source to a muzzle portion of the gun housing.

24. The safety-enhanced gun of claim 23, wherein the light transmission device comprises a translucent plastic.

25. The safety-enhanced gun of claim 16, further comprising an arming mechanism, such that when the gun is armed, power is supplied to the light source.

26. The safety-enhanced gun of claim 16, further comprising electronic circuitry configured to cause the light source to remain illuminated for at least a minimum duration when the conductive mass contacts the conductive ring.

27. The safety-enhanced gun of claim 26, wherein the minimum duration is about three seconds.

28. The safety-enhanced gun of claim 16, wherein the color of light emitted from the light source provides information regarding a firing characteristic of the gun.

29. A method of identifying a gun comprising:

securing an oscillating mass to a gun housing;

illuminating a light source when the oscillating mass oscillates with an amplitude greater than a threshold amplitude, wherein the light source is mounted to the gun housing, and wherein the color of light emitted from the light source provides information about a firing characteristic of the gun; and illuminating the light source when the gun is armed.

30. The method of claim 29, further comprising providing a user-accessible power source configured to provide electrical power to the light source.

31. The method of claim 29, wherein the oscillating mass is mounted to an internal side of the gun housing.

32. The method of claim 29, wherein a red light emission indicates that the gun has an increased firing capacity, and wherein a non-red light emission indicates that the gun has a decreased firing capacity.

* * * * *